US006793494B2

(12) United States Patent
Varshneya et al.

(10) Patent No.: US 6,793,494 B2
(45) Date of Patent: Sep. 21, 2004

(54) METHOD OF ALIGNING A LASER BEAM OF A SAT

(75) Inventors: Deepak Varshneya, Del Mar, CA (US); John B. Roes, San Diego, CA (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 10/151,400

(22) Filed: May 20, 2002

(65) Prior Publication Data

US 2002/0134000 A1 Sep. 26, 2002

Related U.S. Application Data

(62) Division of application No. 09/596,674, filed on Jun. 19, 2000, now Pat. No. 6,406,298.

(51) Int. Cl.[7] ..... F41F 27/00
(52) U.S. Cl. ..... 434/21; 434/19
(58) Field of Search ..... 434/19, 21, 22; 273/371; 33/233, 241, 246, 247, 248, 252, 254, 257

(56) References Cited

U.S. PATENT DOCUMENTS 3,657,826 A * 4/1972 Marshall et al. ..... 434/22
4,246,705 A * 1/1981 Lee ..... 434/22
4,281,993 A 8/1981 Shaw ..... 434/22
4,457,715 A * 7/1984 Knight et al. ..... 434/22
4,827,485 A * 5/1989 Scerbak et al. ..... 372/107
4,987,574 A * 1/1991 Rowley et al. ..... 372/28
5,299,375 A * 4/1994 Thummel et al. ..... 42/115
5,476,385 A * 12/1995 Parikh et al. ..... 434/22
5,590,057 A * 12/1996 Fletcher et al. ..... 702/182
5,991,015 A * 11/1999 Zamel et al. ..... 356/222
6,068,483 A 5/2000 Minor ..... 434/19

* cited by examiner

*Primary Examiner*—Kurt Fernstrom

(57) ABSTRACT

A laser small arms transmitter (SAT) includes a housing having a hollow interior and a clamp structure connected to the housing for rigidly securing the housing to a barrel of a weapon such as an M16A1 rifle. A spyglass shaped metal laser tube is rigidly mounted inside the housing. A lens is mounted in a forward segment of the laser tube and positioned in alignment with a bore in a forward side of the housing. A cylindrical laser diode can is mounted in a rearward segment of the laser tube. A circuit including a photo-optic sensor is mounted inside the housing and selectively energizes the laser diode to cause the same to emit a laser beam through the lens when a blank cartridge is fired. The rear segment of the laser tube is dimensioned and configured so that it can permanently bent to align the laser beam emitted by the laser diode with the barrel of the weapon. When the conventional sights of the M16A1 rifle are zeroed the laser beam will hit the same target reticle as a bullet fired from the rifle at a pre-determined target range.

8 Claims, 6 Drawing Sheets

METHOD OF ALIGNING A LASER BEAM OF A SAT

CROSS-REFERENCE TO RELATED U.S. PATENTS AND APPLICATION

This application is a division of U.S. patent application Ser. No. 09/596,674, filed Jun. 19, 2000 of Deepak Varshneya et al., which issued as U.S. Pat. No. 6,406,298 B1 on Jun. 18, 2002.

BACKGROUND OF THE INVENTION

1. Field of Invention

The present invention relates to military training equipment, and more particularly, to an improved laser transmitter mounted on a rifle for use by a soldier in war games.

2. Description of Related Art

U.S. Army regulations require a soldier to "zero" his or her small arms weapon twice each year. This weapon is typically an M16A1 or M16A2 rifle. The rifle is zeroed by shooting live ammunition at a target twenty-five meters away. The location of a cluster of bullet holes relative to a target reticle is observed and azimuth and elevation adjustments are made to the conventional or so-called "iron" sights of the rifle until the bullets strike at or near the reticle with a higher frequency, thus indicating that the iron sights are correctly adjusted. The parameters of the number of degrees of azimuth and elevation are recorded by the soldier on an adhesive label applied to the rifle so that the conventional sights can be re-set if they should become misaligned, e.g. from the weapon being disassembled for cleaning or repair.

The trajectory of the bullet, as it leaves the rifle, is curved slightly downwardly due to the effects of gravity. Thus, the conventional sights of the M16A2 rifle may be adjusted to achieve a 95% "kill" rate at twenty-five meters and a 95% kill rate at three-hundred meters. A soldier aiming at a target between these two ranges would achieve a much lower kill rate. The geometry of a direct line of sight intersecting a curved bullet trajectory necessarily imposes this limitation on all small arms weapons.

For many years the U.S. Army has trained soldiers with a multiple integrated laser engagement system (MILES). One aspect of MILES involves a small arms laser transmitter (SAT) being affixed to the stock of a small arms weapon such as an M16A1 rifle or a machine gun. Each soldier is fitted with detectors on his or her helmet and on a body harness adapted to detect a laser "bullet" hit. The soldier pulls the trigger of his or her weapon to fire a blank or blanks to simulate the firing of an actual round or multiple rounds. An audio sensor or a photo-optic sensor detects the firing of the blank round(s) and simultaneously energizes a laser diode in the SAT which emits a laser beam toward the target which is in the conventional sights of the weapon.

When fitting the SAT to a rifle or machine gun barrel, in the past it has been necessary to align the transmitter so that a soldier can accurately hit a target with a short burst from the laser diode once he or she has the target located in the conventional rifle sights. According to one prior art approach, the SAT was bolted to the rifle stock and the conventional sights of the weapon were adjusted to align with the laser beam. The disadvantage of this approach is that the conventional weapon sights had to be readjusted in order to use the rifle with live rounds. Thus the rifle was rendered useless for actual combat unless and until it was zeroed. To overcome this disadvantage, later SATs incorporated mechanical linkages for changing the orientation of the laser.

Aligning a SAT has generally been performed using a fixture. One type of prior art small arms alignment fixture (SAAF) that has been used by the U.S. Army for alignment of the early MILES SAT consists of a complex array of one hundred forty-four detectors which are used in conjunction with thirty-five printed circuit boards to determine where the laser hits with respect to a target reticle. The difficulty in using this prior art target array SAAF is that the soldier aims his or her weapon at the array which is twenty-five meters away without the use of a stable platform. In many cases, the soldier fires his or her weapon in a manner which results in the aim point not being at the desired location. The fact that the array is located twenty-five meters away from the soldier also introduces visibility limitations due to snow, fog, wind and poor lighting conditions at sunrise or dusk.

Furthermore, the prior art target array SAAF calculates the number of error "clicks" in both azimuth and elevation. The number of clicks is then displayed on the prior art target array SAAF using four sets of electromechanical display indicators. A soldier must turn his conventional SAT's adjustors the corresponding number of clicks in the correct direction. He or she must then aim and fire the weapon again and make additional corresponding adjustments. This iterative process continues until the soldier obtains a zero indication on the prior art target array SAAF. This is a very time consuming and tedious process due to normal aiming errors incurred each time the soldier has to reacquire the target reticle. It is not uncommon for a soldier to take fifteen minutes to align the SAT to the best of his or her ability and still not have it accurately aligned.

Not only is the alignment process utilizing the prior art target array SAAF time consuming, it also expensive because a large amount of blank ammunition must be used. The laser of a conventional SAT will not fire without a blank cartridge being ignited or by using a special dry fire trigger cable. The prior art target array SAAF does not support optical sights, different small arms weapon types, or night vision devices. Nor does the prior art array target SAAF accurately verify the laser beam energy and encoding of a received laser beam.

In response, SATs which eliminate the need to utilize a large target array have been developed by Cubic Defense Systems, Inc. and deployed by the U.S. Army as part of Cubic's MILES 2000 ® training system. The exercise events and casualties are recorded, replayed and analyzed in detail during "after action reviews" (AARs). The MILES 2000 SATs are adjustable for more rapid and accurate alignment of their laser output. The transmitters feature adjustable powers and coding to enable the man-worn portion of the MILES 2000 system to discriminate between kills made by different small arms and different players.

The MILES 2000 SAT is disclosed in the aforementioned U.S. Pat. No. 5,476,385 of Parikh et. al. It uses a pair of optical wedges that are rotated to steer the laser beam and align the same with the boresight of the rifle. This approach, while achieving a reasonable degree of aligning the laser beam with the conventional sights, requires a relatively expensive construction of the MILES 2000 SAT. This is attributable to the cost of the beam steering components such as the glass wedges, stainless steel gears, shafts, drive gears, housing, etc. The components must be small in size which makes mechanical design tolerances extremely tight. Furthermore the SAT—equipped rifle must be inserted into a portable box-like MILES 2000 SAAF in order to accomplish the bore sighting in a semi-automatic fashion. See the aforementioned U.S. Pat. No. 5,410,815 of Parikh et al. The portable MILES 2000 SAAF itself is a relatively expensive device which must be calibrated.

As disclosed in the pending application referenced above, high temperature resistant adhesive has been used to avoid changes in focal length due heating of the weapon induced by firing repeated blank rounds. Such changes in focal length can severely impact the accuracy of the SAT—equipped rifle once it has been properly bore sighted. Another major problem in maintaining the accuracy of a SAT is attributable to the high accelerations induced in the SAT when a round is discharged. In the case of a machine gun, forces as high as one-thousand times the force of gravity can be generated in all three axes. This can lead to misalignment of parts inside the SAT which can either shift the laser beam away from the preferred alignment or diffuse the beam so that the accuracy of the SAT over long ranges in unacceptably diminished.

Prior attempts to design an accurate SAT have led to unduly expensive and complex solutions because they have been based on aligning the laser beam with the conventional sights of the weapon Since the laser beam travels in an absolutely straight path, it needs to be somewhat downwardly biased in elevation to simulate the effects of gravity on the bullet. There is an inherent problem in this approach in that the laser is being aligned with the conventional sights which themselves may not be zeroed. Once the weapon is zeroed, the SAT is then misaligned. Furthermore, the whole process of aligning the SAT is unrealistic for a soldier, who should only engage in training activities which themselves mimic actual combat operations and maneuvers.

Accordingly, it would be desirable to provide a low cost small arms transmitter that can be properly aligned in a simpler and more inexpensive fashion and would thereafter maintain its accuracy in a harsh combat training environment.

SUMMARY OF THE INVENTION

Accordingly, it is the primary object of the present invention to provide an improved laser small arms transmitter (SAT) for use in simulated combat exercises.

Another object is to provide an improved SAT that can be manufactured at relatively low cost.

Another object of the present invention is to provide an improved SAT that is easier and less costly to align.

Another object of the present invention is to provide an improved SAT that will maintain its accuracy for long durations despite the high temperatures and high accelerations typically encountered in a combat training environment.

Another object of the present invention is to provide an improved method of aligning a SAT that is simpler, less expensive and more accurate than previous methods.

Another object of the present invention is to provide a SAT with greater effective range under varying temperature conditions.

Another object of the present invention is to eliminate the necessity for a soldier to align a SAT mounted on his or her small arms weapon.

Another object of the present invention is to eliminate expensive laser beam steering components in a SAT.

In accordance with the present invention, a laser small arms transmitter (SAT) includes a housing having a hollow interior and a clamp structure connected to the housing for rigidly securing the housing to a barrel of a weapon. A laser tube is rigidly mounted inside the housing. A lens is mounted in a forward portion of the laser tube and positioned in alignment with a bore in a forward side of the housing. A semiconductor laser device is mounted in a rearward segment of the laser tube. A circuit mounted inside the housing selectively energizes the semiconductor laser device to cause the same to emit a laser beam through the lens. The rear segment of the laser tube is made of a material that is permanently bendable. The rear segment of the laser tube is also dimensioned and configured so that it can be bent to align the laser beam emitted by the semiconductor laser device relative to the barrel of the weapon.

Another aspect of the present invention is a method of aligning a laser beam of a small arms transmitter to the barrel of a small arms weapon. The method first involves the step of mounting a small arms transmitter on a fixture pre-aligned with a center of a target reticle. The next step of the method involves energizing a semiconductor laser device in the small arms transmitter to cause a laser beam to be emitted thereby. The final step of the method involves aligning the semiconductor laser device so that the laser beam strikes at or near the center of the target reticle to thereby align the laser beam with the barrel of the small arms weapon to which it will be mounted.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, wherein.

DETAILED DESCRIPTION OF THE PREFERRED EMBODIMENTS

Figure 1:
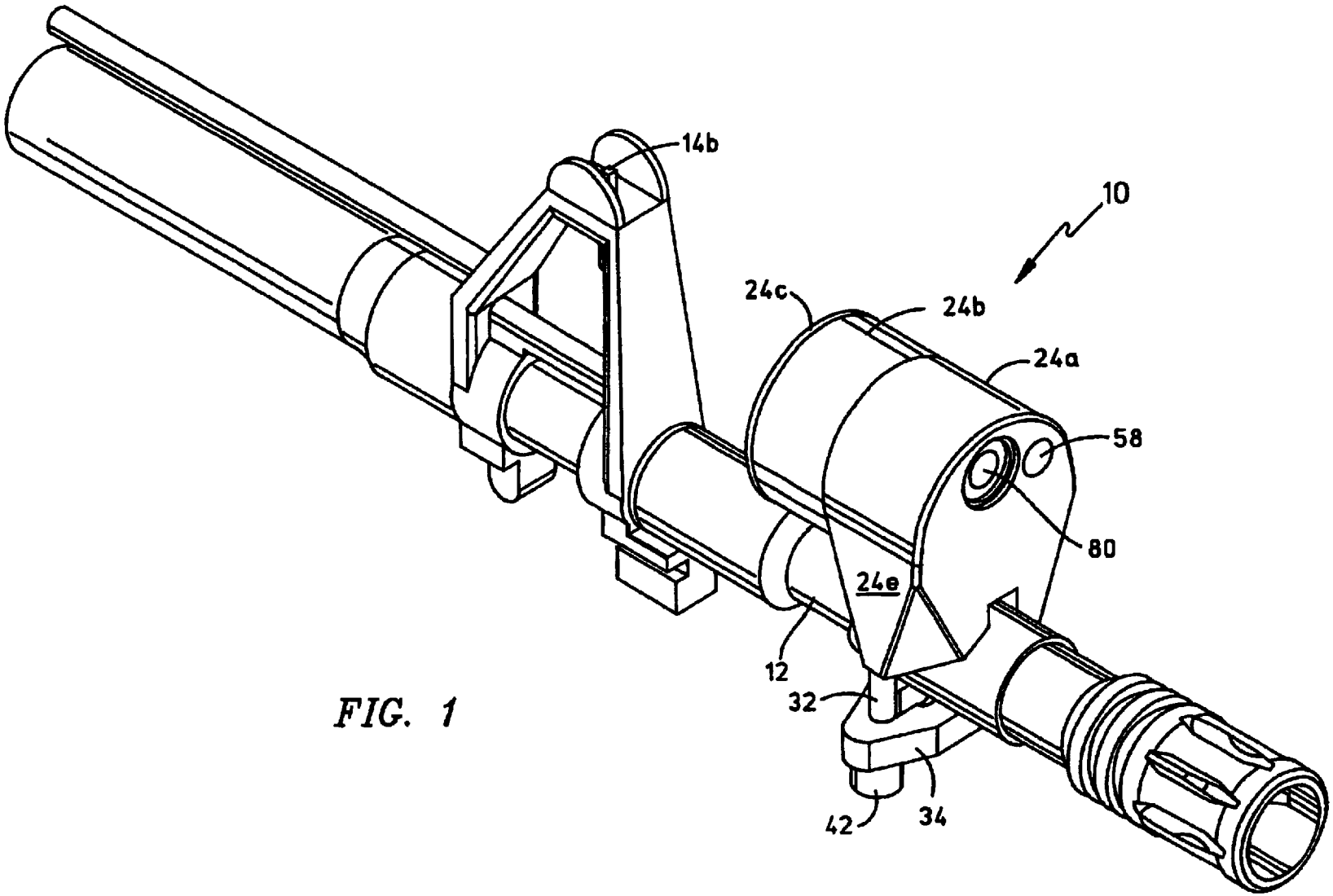
FIG. 1 is a perspective view illustrating a preferred embodiment of a SAT constructed in accordance with the present invention, the SAT being clamped to the barrel of an M16A1 rifle.
Figure 11:
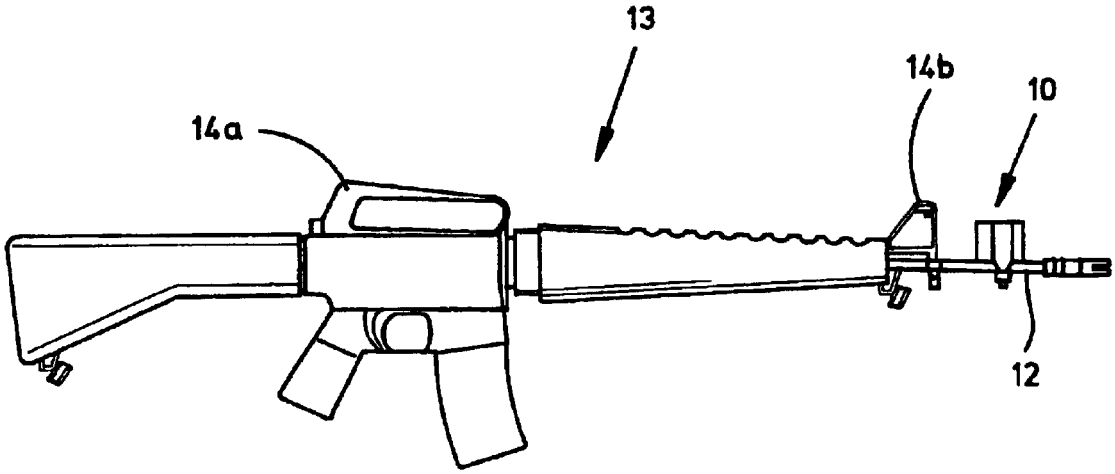
FIG. 11 is a side elevation view of an M16A1 rifle equipped with the SAT of FIG. 2.

Referring to FIG. 1, a preferred embodiment of our invention is illustrated in the form of a laser small arms transmitter (SAT) 10 which may be bolted to the barrel 12 of a small arms weapon such as an M16A1 rifle 13 (FIG. 11). The weapon may then be used by a soldier in combat training exercises, which are sometimes referred to as "war games." The SAT 10 could also be used on the barrel of a machine gun, sniper rifle, hand gun or other small arms weapon. The cylindrical barrel 12 (FIG. 1) of the M16A1 rifle 13 is precision machined so that the outer surface to which the SAT 10 is clamped is parallel to the central longitudinal axis of the barrel 12. This outer surface is a precise known distance from the central axis of the barrel 12. Thus, as explained hereafter in detail, the laser beam emitted by the SAT 10 may be aligned with the barrel 12 so that the laser beam will strike the same target reticle a predetermined distance away as a bullet fired from the rifle when the target is in the conventional sights of the rifle. The conventional sights of the M16A1 rifle include a rearward sight 14*a* (FIG. 11) (not shown) nearer the soldier's eye and a forward sight 14*b* (FIG. 1) extending upwardly from the forward portion of the barrel 12.

Figure 2:
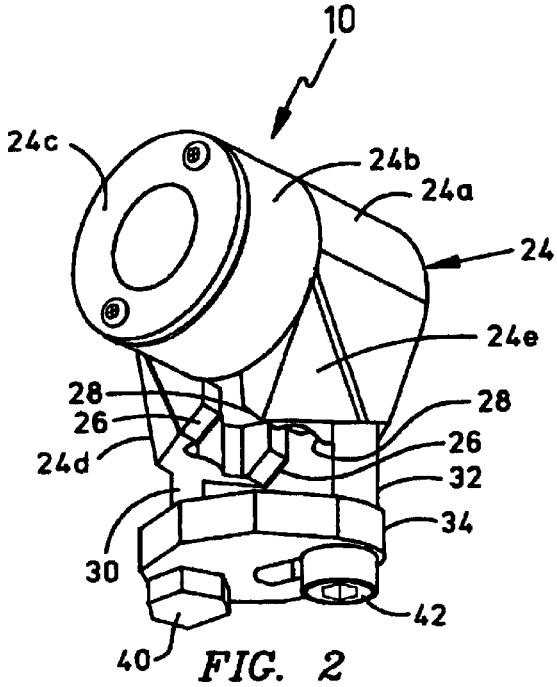
FIG. 2 is a perspective view of the SAT of FIG. 1 illustrating the rear and under sides thereof.
Figure 4:
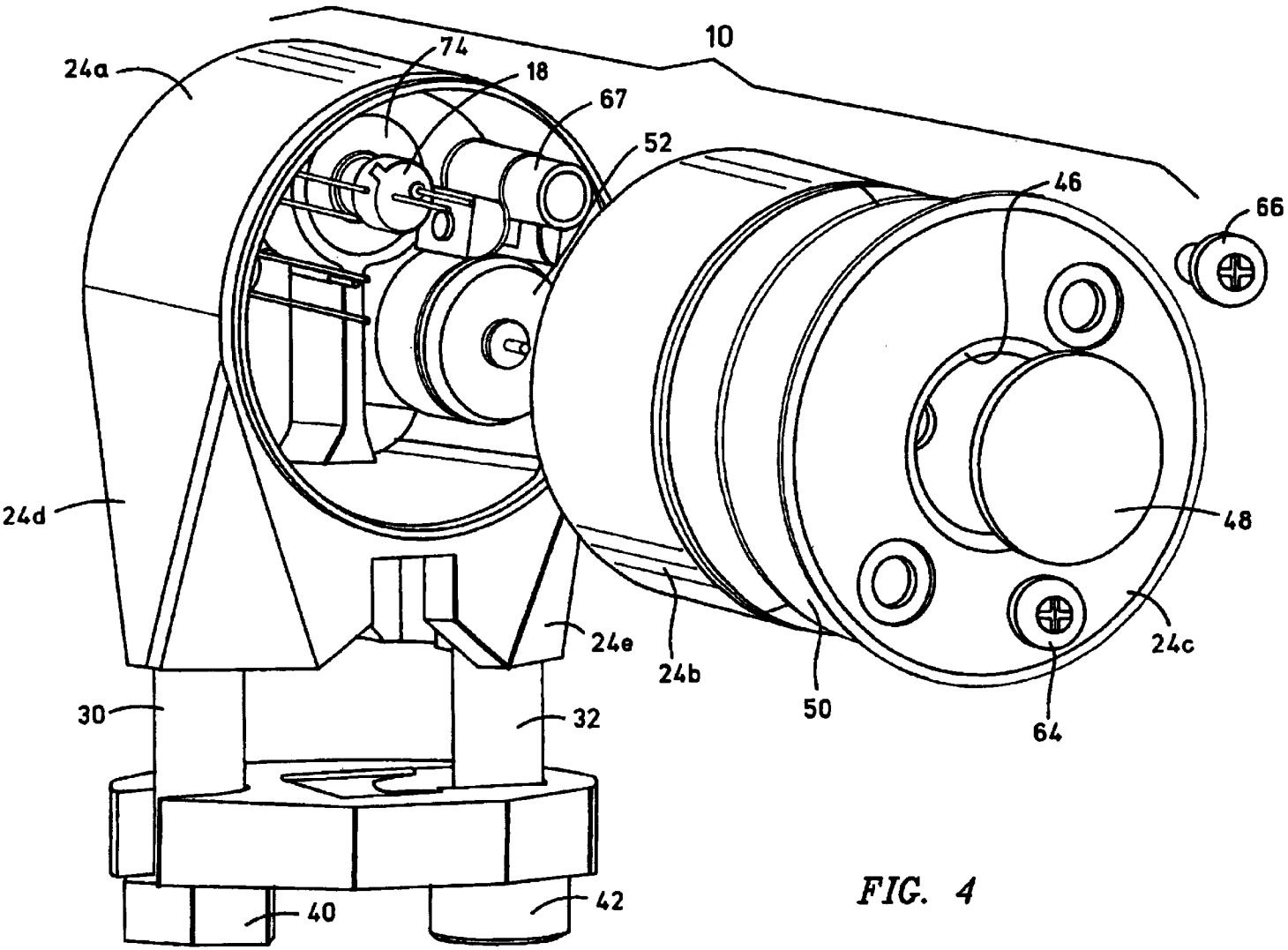
FIG. 4 is an enlarged exploded perspective view of the SAT illustrated in FIG. 2.

Referring to FIG. 2, the SAT 10 is an electromechanical device that "fires" a laser beam 16 (FIG. 8) emitted by a laser diode 18 when the trigger of the rifle 13 is pulled. A player identification (PID) code is encoded in the laser beam 16 via control circuit 20 by any well known technique, such as intensity modulation, so that the identity of a soldier who has made a "kill" with the rifle can be ascertained. The power of the laser beam may also be adjusted to simulate different types of small arms. The laser diode 18 is energized via a driver circuit 22 coupled between the laser diode 18 and the control circuit 20. As shown in FIG. 4, the laser diode 18 is preferably a semiconductor device mounted in a cylindrical can in the conventional manner. It preferably emits a laser beam having a MILES compatible wavelength of between approximately twelve and one-half and forty microns. Suitable semiconductor laser devices are commercially available from EGG Corporation and others. They typically include a semiconductor chip mounted inside the can behind a transparent window in the forward side of the can. The alignment of the semiconductor chip inside the can, and thus the angle of the laser beam emitted thereby, is subject to tolerance variations from device to device.

As illustrated in FIGS. 2 and 4, the SAT 10 includes a generally cylindrical housing 24 having a forward portion 24*a* and an intermediate sleeve portion 24*b* and a disk-shaped rear cover portion 24*c*. The forward portion 24*a* is integrally formed with spaced apart downwardly extending projections 24*d* and 24*e* (FIG. 2). The projections 24*d* and 24*e* form opposing ninety degree tapered surfaces 26 and 28 that provide a generally V-shaped receptacle for engaging the outer surface of the barrel 12. The forward housing portion 24*a* is preferably made of Titanium alloy that is cast and then precision machined. It could also be made of heat treated stainless steel or any other material that can be formed or machined to provide the close tolerances required.

Figure 3:
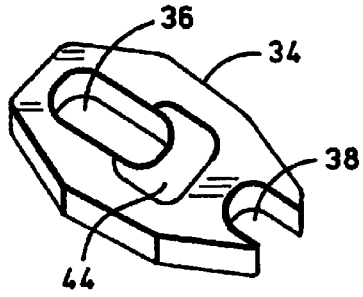
FIG. 3 is a perspective view of the clamp of the SAT of FIG. 2.

Shafts 30 and 32 (FIG. 4) extend downwardly from the projections 24*d* and 24*e*. A clamp 34 (FIG. 3) has a pair of apertures 36 and 38 through which the shafts 30 and 32 extend, respectively. A bolt head 40 (FIG. 4) on the lower end of the shaft 30 prevents the clamp 34 from being completely removed. A female threaded lock nut 42 threads over a male threaded lower end of the shaft 32 and can be tightened to press the clamp 34 against the underside of the barrel 12 as best seen in FIG. 1. This holds the SAT 10 securely in position on the barrel 12. The elongated shape of the aperture 36 (FIG. 3) in the clamp 34 and the open side of the aperture 38 facilitate removal of the SAT 10 from the weapon 13 without risk of losing the clamp 34. A recess 44 is formed in an upper side of the clamp 34. Preferably the shafts 30 and 32 and clamp 34 are made of the same material as the housing 24.

The rear cover portion 24*c* (FIG. 4) of the housing 24 has a large aperture 46 formed in the center thereof which is covered by an IR transparent disk-shaped window 48 which is glued or otherwise permanently secured to the rear cover portion 24*c*. A pair of disk-shaped circuit boards, only one 50 of which is shown in FIG. 4, are mounted inside the housing 24 directly forward of the window 48. These circuit boards support and electrically interconnect the components illustrated in FIG. 8, except for the battery 52, the laser diode 18 and the photo-optic sensor 58. These components include the control circuit 20, the driver 22, a Mercury position sensing switch 54, an infrared sensor 56 and a photo-optic sensor 58. The Mercury switch 54 turns ON the SAT 10 when the rifle 13 is moved to a generally horizontal orientation and turns OFF the SAT 10 when the rifle 13 is stowed in a substantially vertical orientation. The solder can send infrared PID signals shown diagrammatically in FIG. 8 as waves 59 to the SAT 10 to encode his or her identity or to program other characteristics such as the total available number of simulated rounds, laser power, etc. These infrared signals are received by the infrared sensor 56, amplified by an amplifier 60 also mounted on one of the circuit boards such as 50 and then fed to the control circuit 20 where they are digitized and processed. Visible light generated by the firing of a blank cartridge or round in the breech of the rifle 13 is emitted from the tip of the barrel 12 and is sensed by the photo-optic sensor 58, which may be of the lead-sulfate type. The light is shown diagrammatically in FIG. 8 as arrows 61. The signals from the photo-optic sensor 58 are amplified by another amplifier 62 also mounted on one of the circuit boards such as 50. Each time the control circuit 20 detects the firing of a blank round it momentarily energizes the laser diode 18 via the driver 22.

Figure 5:
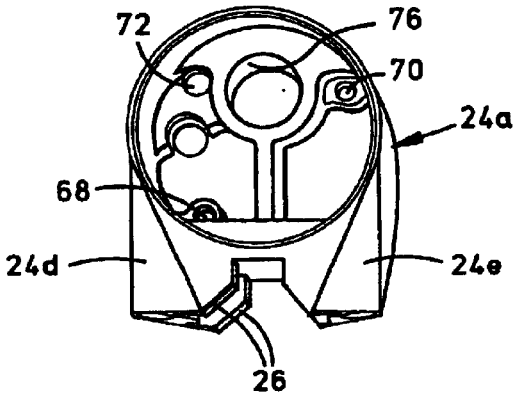
FIG. 5 is a perspective view of the forward portion of the housing of the SAT of FIG. 2 showing the internal configuration thereof.

Referring again to FIG. 4, the battery 52 is mounted inside the forward portion 24*a* of the housing 24 of the SAT 10, forward of the circuit boards. The battery 52 is preferably a Lithium battery that can power the operations of the SAT 10 for at least two years at normal expected levels of training usage before being replaced. Battery replacement is achieved by removing the rear cover portion 24*c*. This is accomplished by loosening a pair of screws 64 and 66, the full lengths of which are not shown in FIG. 4 for the sake of clarity. In FIG. 4, a cylindrical spacer 67 is shown that surrounds the shaft of the screw 66. The distal ends of the screws 64 and 66 are screwed into female threaded holes 68 and 70 (FIG. 5) formed in the rear side of the forward side of the forward portion 24*a* of the housing 24. The photo-optic sensor 58 has a cylindrical shape and is press fit into a round aperture 72 that extends through the forward side of the forward housing portion 24*a*. The photo-optic sensor 58 preferably has a window integral therewith that is visible in FIG. 1 in the front side of the SAT 10.

Figure 6:
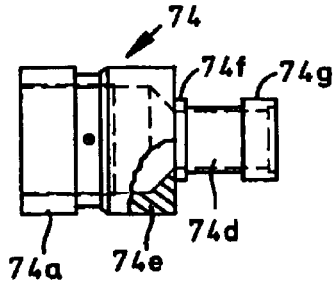
FIG. 6 is an enlarged side elevation view of the laser tube of the SAT of FIG. 2 with a portion thereof broken away and with phantom lines that show the various internal diameters thereof.

Referring still to FIG. 4, the laser diode 18 is shown in the form of a generally cylindrical can. The laser diode 18 is mounted in the rear end of a laser tube 74 (FIG. 6). The laser tube 74 is preferably made of the same metal as the forward housing portion 24*a*. The laser tube 74 has a stepped cylindrical or "spyglass" configuration. The forward segment 74a thereof is snugly and tightly press fit into a cylindrical bore 76 (FIG. 5) that extends through the forward side of the forward housing portion 24*a*. It is important that the outer diameter of the forward laser tube segment 74*a* closely match the inner diameter of the bore 76 so that even minute lateral movement of the central longitudinal axis of the laser tube 74 relative to the forward housing portion 24*a* is prevented. This avoids any unwanted movement of the axis of the laser tube 74 relative to the central axis of the weapon barrel 12, to which the SAT 10 is firmly secured via the clamp 34. It should be understood that as used herein the term "laser tube" refers to any support structure, cylindrical or otherwise, that is used to support the laser diode 18 within the housing 24 of the SAT and maintain the same in proper alignment.

Figure 8:
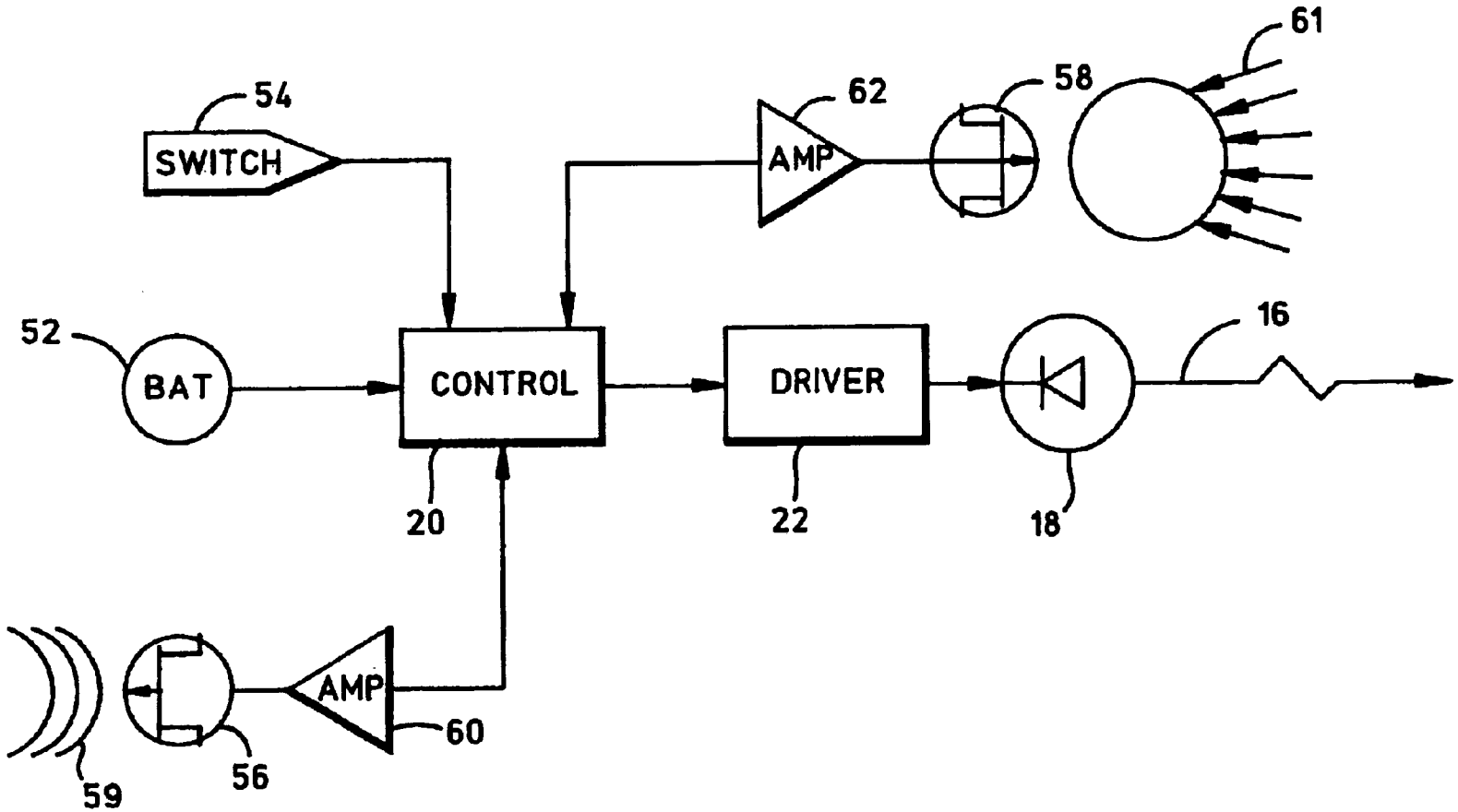
FIG. 8 is a functional block diagram of the circuit of the SAT of FIG. 2.

Referring still to FIG. 8, the laser diode 18 is energized by the driver circuit 22 on one of the round circuit boards such as 50 that are mounted inside the housing 24. As illustrated in FIG. 4, the laser diode 18 is actually a semiconductor device mounted within a cylindrical metal support can having electrical leads extending from its rearward end. For the sake of convenience the term "semi-conductor laser device" shall refer to the entire assembly including the semiconductor chip and its outer cylindrical housing which may or may not have a window or lens mounted in its forward end.

Figure 7:
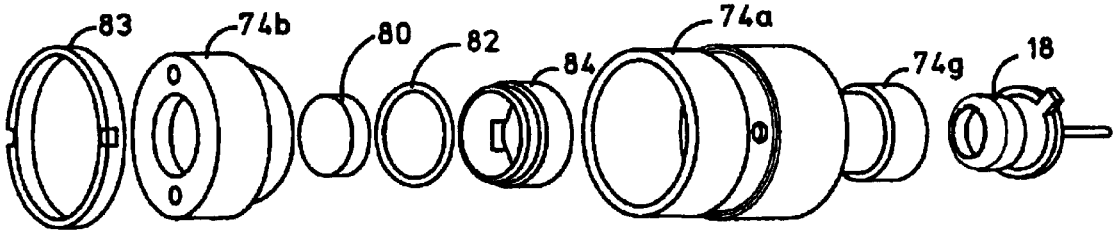
FIG. 7 is an enlarged exploded perspective view illustrating the mounting of the lens and the laser diode in the forward and rearward ends, respectively, of the laser tube of the SAT of FIG. 2.

The laser diode 18 emits a laser beam 16 when energized as shown diagrammatically in FIG. 8. Ideally, the laser beam does not substantially disperse, i.e., it does not lose intensity at increasing distances from the laser diode 18 due to beam spreading. In other words, the distance $\tau$—representing a distance from the edge of the laser beam to the beam's centerline—remains substantially constant. This dispersion characteristic is related to the focal length $f$ of the lenses used in the optical system that includes the laser diode 18, a relationship that is known to those skilled in the art. The laser beam suffers a loss of intensity because $\tau$ increases as a function of the distance from the lens at which the laser beam intensity is measured. The focal length of the SAT 10, i.e., the distance between the semiconductor chip and the lens 80 (FIG. 7) at the forward end of the laser tube 74, is preferably between about ten millimeters and forty millimeters. The dispersion or divergence angle a may vary depending upon whether an increase or decrease in temperature is adversely affecting the laser diode 18. For example, as multiple blank cartridges are fired in the rifle 13, the rifle barrel 12 may expand. This expansion is caused by the heating of the barrel 12 due to the firings as well as the heating of the SAT 10 from multiple energizations of the laser diode 18, resulting in the expansion of the materials used to construct both the rifle 13 and the SAT 10. Variations in the focal length can be minimized by using compatible materials with similar coefficients of thermal expansion and by using high temperature resistant adhesive where parts are adhesively joined.

If the components of the laser tube 74 (FIG. 6) expand due to heating, the focal distance between the semiconductor chip of the laser diode 18 and the glass lens 80 proportionately increases. This proportional increase may also increase the dispersion angle $\alpha$ and may result in a decreased intensity in the laser beam. Also, the increase in the dispersion angle $\alpha$ also results in the distance $\tau$—the distance from the optical centerline to the laser beam at a given distance—to increase greatly, thereby enlarging the laser beam pattern. The result is that the laser beam loses intensity and may not activate MILES indicators worn by a soldier engaged in a staged conflict. At closer ranges, the dispersion of the laser beam can result in a hit being incorrectly recorded. For example, a "laser" hit might result although a live blank cartridge fired through the barrel of the rifle 13 would not have resulted in a hit, i.e. the target was not in the conventional sights of the rifle. In other words, the laser beam is no longer properly aligned with the barrel 12 of the rifle 13.

The difficulties described with respect to the reduced intensity of the laser beam when used in a laser engagement system are overcome by the present invention. The laser diode 18 is bonded to the rear end of the laser tube with a special high temperature resistant adhesive. In addition, the laser tube 74 is provided with a means for adjusting its focal length and maintaining the selected focal length with a high degree of accuracy. The periphery of the glass lens 80 (FIG. 7) seats against an inwardly extending annular lip or flange of a mounting cylinder 74*b*. By way of example, the lens 80 may be made of C0550 material available from Corning Glass. An elastomeric mounting member such as an O-ring or gasket 82 made of a suitable high temperature resistant material such as that sold under the trademark VITON is positioned on the rear side of the lens 80. A lock nut 84 with male threads (not illustrated) is screwed inwardly along a female threaded portion of the mounting cylinder 74*b* to squeeze the O-ring 82 against the lens 80 and hold the lens 80 firmly against the lip of the mounting cylinder 74*b*. The rearward end of the mounting cylinder 74*b* has male threads (not illustrated) that screw into female threads (not illustrated) in the forward segment 74*a* of the laser tube 74. The mounting cylinder 74*b* is turned to establish the desired focal length of the laser tube 74 since this moves the lens 80 toward or away from the laser diode 18. Once the desired focal length has been achieved a ring-shaped lock nut 83 with female threads (not illustrated) is screwed over the forward portion of the mounting cylinder 74*b* and tightly against the forward end of the forward segment 74*a* of the laser tube 74. This locks the lens 80 in position.

The laser diode 18 is preferably held inside a rear segment 74*d* (FIG. 6) of the laser tube 74 with a suitable high temperature resistant adhesive which is preferably a mixture of fifty weight percent VERSAMID™ adhesive and fifty weight percent EPON 828™ adhesive. This adhesive is cured at high temperatures to achieve a Tg which is at least approximately ten to fifteen percent higher than the maximum expected operating temperature of the SAT 10. Alternatively the laser diode 18 could be soldered inside the rear laser tube segment 74*d*.

The construction of the laser tube 74 and its associated parts as described above allows the physical tolerances of the entire assembly to be maintained during temperature variations below the maximum expected operating temperature of the SAT 10. It is possible to align the mechanical axis to the optical axis with tolerances better than one mrad. This may be accomplished by selecting a lens $f$ number of approximately three and a laser diode 18 whose near field effective waist diameter is relatively constant over the fabrication tolerances. The mechanical design of the SAT 10 and the utilization of a high-temperature resistant adhesive to mount the laser diode 18 reduces the dispersion of the laser beam.

Figure 9:
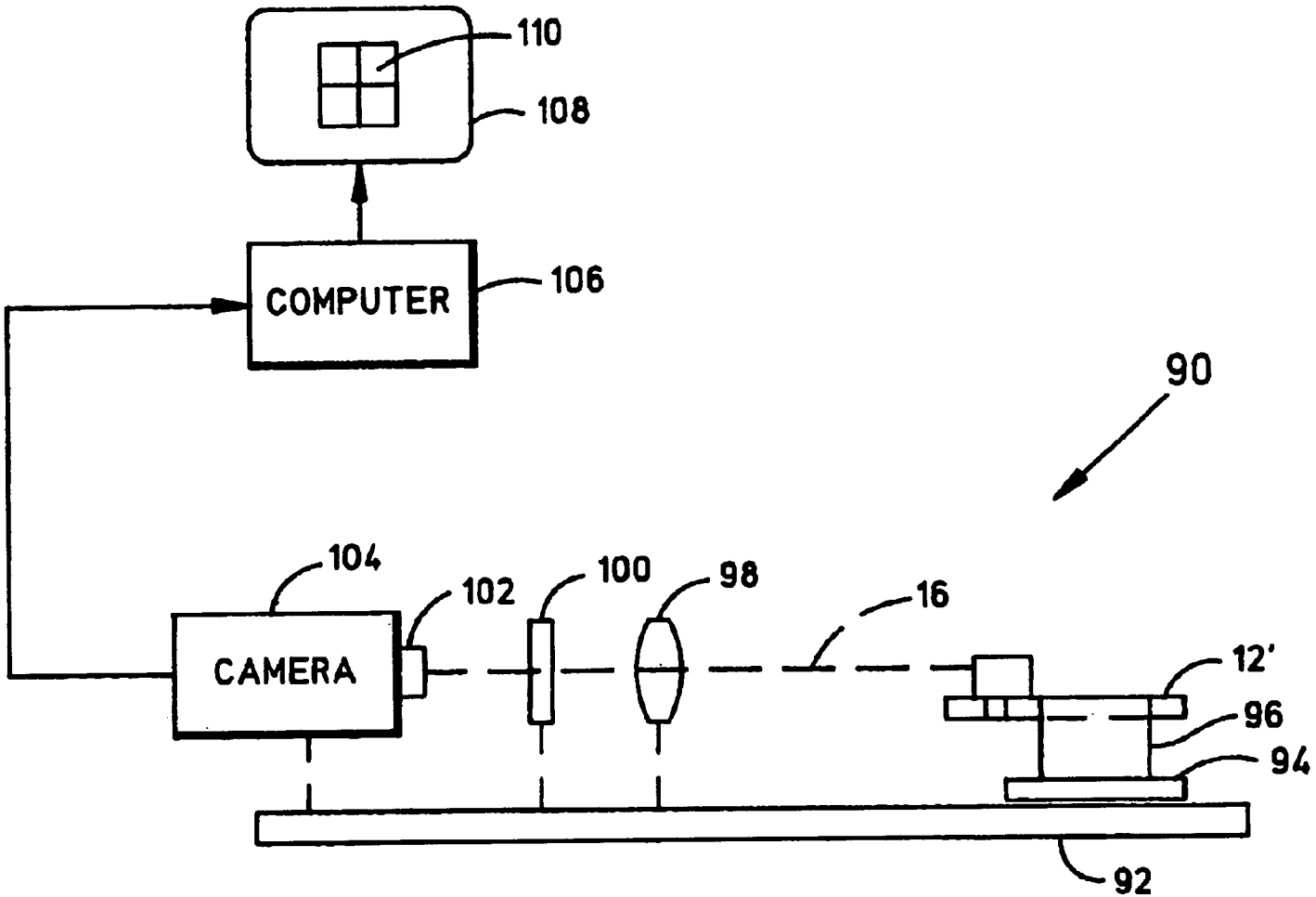
FIG. 9 is a diagrammatic side elevation view of a fixture that may be used to align the laser beam of the SAT of FIG. 2 with the barrel of a rifle.

FIG. 9 is a diagrammatic side elevation view of a fixture 90 that may be used to align the laser beam 16 of the SAT 10 with the barrel 12 of the M16A1 rifle 13 (FIG. 11). The fixture 90 includes a rigid horizontally extending frame 92. A horizontal platform 94 is moveable longitudinally (left and right in FIG. 9) and laterally (in and out of the plane of FIG. 9) via lockable screw mechanisms (not illustrated). A simulated segment 12' of the barrel 12 of the M16A1 rifle 13 may be mounted and locked into a groove in a mounting block 96 carried by the platform 94. The SAT 10 is clamped to the simulated barrel 12'. The laser beam 16 from the SAT 10 passes through a far field lens 98 and a filter 100 into the lens 102 of a video camera 104. The lens 98, filter 100 and camera 104 are also mounted at predetermined locations on the frame 92 of the fixture 90 with appropriate adjustable supports shown diagrammatically as vertical phantom lines in FIG. 9. The output signal from the video camera 104 is fed to a personal computer 106 which drives a CRT display 108.

The platform 94 (FIG. 9) of the fixture 90 is initially aligned by mounting a short aiming barrel segment (not shown) in the mounting block 96. The short aiming barrel segment has a red laser whose beam is perfectly aligned with the central axis of the aiming barrel segment. The personal computer has suitable beam analyzing software loaded thereon which allows it to display a target reticle 110 and a spot indicating the relative location of the point where the laser beam strikes the CCD of the camera 104. Suitable beam analyzer software is available under the trademark SPIRICON. The azimuth and elevation of the platform 94 are then adjusted to place the laser beam spot at the center of the target reticle 110. The aiming tube is then replaced with the simulated barrel segment 12' and the SAT 10 is clamped to the simulated barrel segment 12'.

The rear cover portion 24*c* of the housing 24 is removed and the control circuit 20 of the SAT 10 is commanded, via an IR command sent to infrared sensor 56, to continuously energize the laser diode 18. The distal end of a strong, rigid alignment tube (not shown) of approximately ten inches in length and having a suitable inside diameter is placed over the rear laser tube segment 74*d*. The proximal end of the alignment tube is manually moved until the spot representing the point of impact of the laser beam 16 on the camera CCD is near, and preferably centered on, the center of target reticle 92. The rear laser tube segment 74*d* is bent, i.e.. permanently deformed so that the laser diode 18 inside of the same stays precisely pointed and the laser beam 18 is aligned. The alignment tube is then removed. The lock nut 83 is loosened and the mounting cylinder 74*b* is rotated to achieve the desired beam divergence. The lock nut 83 is then tightened. The rear cover portion 24*c* of the housing 24 is screwed on and the continuous illumination of the SAT 10 is terminated by another IR command sent via infrared sensor 56 to the control circuit 20.

Thus it is important that the laser tube 74 be made of metal or other material that is permanently bendable, i.e. it can be moved past its point of elasticity to a state of permanent deformation. Furthermore, the laser tube 74 must be dimensioned and configured for easy bending of the rear segment 74*d* in azimuth and elevation relative to its central longitudinal axis. Thus the shape of the laser tube 74 in which the diameter of the rear segment 74*d* is substantially less than the diameter of the remaining portion of the laser tube 74 has been found to be particularly advantageous. The wall thickness of the intermediate segment 74*e* (FIG. 6) of the laser tube 74 is considerably greater than that of the rear segment 74*d*. The wall thickness of the forward segment 74*a* of the laser tube 74 is also considerably greater than that of the rear segment 74*d*. The laser tube 74 is formed with a collar portion 74*f* at the transition between the rear segment 74*d* and the intermediate segment 74*e* that ensures that most of the bending will occur just aft of this location. The rear end of the rear segment 74*d* is provided with a gripping collar 74*g* over which the alignment tube is snugly fit. Thus the laser tube 74 has a spyglass configuration with a laser diode receiving portion that may be permanently bent to align the laser beam.

Thus the term "alignment fixture" as used herein shall include not only an actual weapon but a jig, frame or other support structure to which the SAT 10 may be secured or mounted in any convenient fashion for the purpose of aligning the laser diode 18 within the SAT 10. Once this has been accomplished the SAT 10 can be mounted to any small arms weapon of the type for which the SAT 10 has been aligned and the laser beam 16 of the SAT 10 will strike a target that is in the conventional sights of the weapon at the predetermined distance provided the weapon has been properly zeroed. It will be understood that the fixture 90 (FIG. 9) is preferably pre-aligned so that the beam 16 emitted from the laser diode 18 of the SAT 10 will be aligned with a slight downward bias to take into account the downward curvature of the bullet due to the effects of gravity. This will ensure that both a bullet fired from the M16A1 rifle 13 and the laser will hit the same target at a pre-determined range of, for example, two hundred and fifty meters.

Instead of bending the laser tube the rear laser tube segment could be dimensioned to allow the laser diode to be slightly moved in azimuth and elevation inside the rear segment 74*d* during the alignment process and then adhesively secured in the proper alignment position. The laser diode 18 could also be supported on a two-axis gimbaled platform fixed to the rear end of the laser tube 74 whose position could be fixed with adhesive or other suitable means such as threaded adjustments. However, both these approaches would require tedious use of devices to move the laser diode 18 minute amounts in azimuth and elevation and holding the same in precise position while the adhesive hardens.

Figure 10:
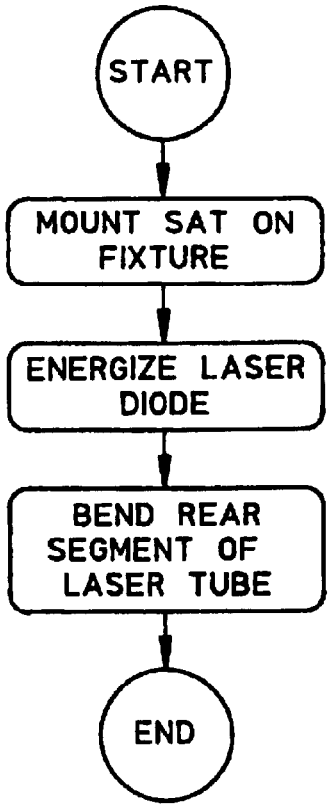
FIG. 10 is a flow diagram illustrating the steps of the method of the present invention which enables the SAT of FIG. 2 to be aligned with the bore sight of a small arms weapon.

FIG. 10 is a flow diagram illustrating the steps of the method of the present invention which enables a laser small arms transmitter such as the SAT 10 of FIG. 2 to be permanently aligned with the barrel of a small arms weapon such as the M16A1 rifle 13 illustrated in FIG. 9. The method first involves the step of mounting the SAT 10 on a pre-aligned fixture. The fixture can either be an actual weapon such as the M16A1 rifle 13 or a support structure that simulates the aiming of the weapon so that the central axis of its barrel is aligned with the center of the target reticle 110. The next step of the method involves energizing the laser diode 18 in the SAT 10 to cause the laser beam 16 to be emitted thereby. The final step of the method involves permanently bending the rear segment 74*d* of a laser tube 74 in which the laser diode 18 is mounted until the laser beam 16 strikes the center of the target reticle 110.

It will thus be understood that the SAT 10 is rugged and reliable in construction. It need only be aligned "in the factory" and will thereafter maintain a high degree of accuracy even when subjected to temperature variations and recoil forces encountered over long periods of training exercises. The SAT 10 is relatively small in size and lighter than prior art SATs so that the soldier's weapon has a weight and balance that is more similar to his or her weapon in its normal configuration, i.e. without a SAT attached thereto. The SAT 10 is relative low in cost because it does not require the use of the elaborate target array SAAF or portable box-like automated SAAF used by prior art SATs. In addition, the SAT 10 has a relatively non-complex internal construction that eliminates the rotatable optical wedges, gears, drive shafts and other components of the prior art automatically adjustable SAT. These components are not only expensive, but introduce tolerance and shock resistance issues that affect long term accuracy. Soldiers no longer need to waste valuable time re-aligning their SATs every two weeks. For that matter, soldiers no longer have to learn any SAT alignment protocols when their rifles are equipped with the SAT 10. They can instead concentrate on the various nuances of the realistic combat training exercises. The SAT 10 automatically turns itself ON and OFF when the weapon is in horizontal use and vertical stowage, respectively. It will remain operational for approximately two years of normal expected usage based on the amount of power stored in the long lasting Lithium battery 52. Thereafter the battery can be quickly and easily replaced. A PID code for the soldier, the number of available rounds, the power of the laser, and other commands can be programmed into the control circuit via the infrared sensor 56.

Our SAT 10 is aligned to the barrel of the small arms weapon, and not to its conventional sights. Thus, if a soldier correctly aims at a target but still misses, this indicates that the weapon is not properly zeroed. Thus we have also provided a method of determining whether the conventional sights of a small arms weapon have been properly zeroed.

While we have described a preferred embodiment of our low cost laser small arms transmitter, and our method of aligning the same, it should be apparent to those skilled in the art that our invention may be further modified in both arrangement and detail. For example the ignition of a blank cartridge could be detected with an audio sensor that would sense the bang associated with firing a blank. Therefore, the protection afforded our invention should only be limited in accordance with the scope of the following claims.

We claim:

1. A method of aligning a laser beam of a small arms transmitter to the barrel of a small arms weapon, comprising the steps of:

mounting a small arms transmitter on a fixture pre-aligned with a target reticle;

energizing a laser device in the small arms transmitter to cause a laser beam to be emitted thereby; and aligning the laser device so that the laser beam strikes at or near a center of the target reticle to thereby align the laser beam with the barrel of a small arms weapon, wherein the laser device is aligned by bending a portion of a laser tube in which the laser device is mounted.

2. The method of claim 1 wherein the fixture simulates a rifle.

3. The method of claim 1 wherein the fixture is a rifle.

4. The method of claim 1 wherein the laser beam is pointed at a camera connected to a computer which displays an image of the target reticle and an image of the location of the laser beam relative to the target reticle.

5. The method of claim 4 wherein a far field lens is located in the optical path between the small arms transmitter and the camera.

6. The method of claim 1 and further comprising the step of adjusting a focal length of the laser tube in the transmitter in which the laser device is mounted to achieve a predetermined divergence of the laser beam.

7. The method of claim 1 wherein the fixture is pre-aligned by adjusting an azimuth and an elevation of a moveable portion of the fixture that supports the small arms transmitter.

8. A method of determining whether the conventional sights of a small arms weapon have been properly zeroed, comprising the steps of:

mounting a laser small arms transmitter on a barrel of a small arms weapon equipped with conventional sights;

aligning a laser beam emitted by the transmitter with the barrel, the alignment including bending a portion of a laser tube in which a laser device of the laser small arms transmitter is mounted and providing a downward bias of the laser beam so that the laser beam intersects the path of a bullet fired from the barrel a predetermined range;

aiming the small arms weapon at a target with the convention sights, the target being located at the predetermined range;

detecting whether the laser beam has impacted the target; and providing a signal to a person if the laser beam has struck the target to thereby indicate that the small arms weapon has been properly zeroed.

* * * * *